US006575274B1

(12) United States Patent
Huang

(10) Patent No.: US 6,575,274 B1
(45) Date of Patent: Jun. 10, 2003

(54) ADJUSTABLE PULLING HANDLE FOR ROLLAWAY LUGGAGE

(76) Inventor: Chiung-Chu Huang, P.O. Box 697, Feng-Yuan City (TW), 420

( * ) Notice: Subject to any disclaimer, the term of this patent is extended or adjusted under 35 U.S.C. 154(b) by 0 days.

(21) Appl. No.: 10/067,405

(22) Filed: Feb. 7, 2002

(51) Int. Cl.[7] ..... A45C 13/00
(52) U.S. Cl. ..... 190/115; 16/113.1
(58) Field of Search ..... 190/115, 18 A; 16/113.1; 280/47.315, 47.371, 37, 655, 47.17, 645

(56) References Cited

U.S. PATENT DOCUMENTS 5,689,854 A * 11/1997 Wang ..... 190/115 X
5,706,921 A * 1/1998 Wang ..... 190/115
5,803,214 A * 9/1998 Wang ..... 190/115
5,806,142 A * 9/1998 Wang ..... 190/115
6,047,442 A * 4/2000 Workman ..... 16/113.1 X
6,247,203 B1 * 6/2001 Kuo ..... 190/115 X
6,409,207 B1 * 6/2002 Kuo ..... 190/115 X

* cited by examiner

*Primary Examiner*—Tri M. Mai

(57) ABSTRACT

An adjustable pulling handle for rollaway luggage includes a pair casters on lower end of the luggage case, a pair of handle sheaths on the back of the luggage case and a top plate on the top of the luggage case. A pair of rotors rotatably dispose in a pair of receiving space in the top plate for controlling the rotation of an inverse U-shaped pulling handle. A downward moving plate in cooperation with a pair of laterally moving plates to control the movement of the rotors. Thereby, pulling up the pulling handle and pressing the downward moving plate, both the rotors and the putting handle can be rotatable to facilitate a user to select an optimal slant angle for the pulling handle in order to be comfortable and saving energy when the luggage case rolled with the steps of the user.

1 Claim, 10 Drawing Sheets

ADJUSTABLE PULLING HANDLE FOR ROLLAWAY LUGGAGE

BACKGROUND OF THE INVENTION

The present invention relates to wheeled luggages and more particularly to an adjustable pulling handle for rollaway luggage which the pulling handle can be adjusted to different angle to suit to the height of the user.

A suitcase is indispensable to the people in traveling. It can carry many articles necessary to the traveler. A rollaway luggage case is move convenient to board an airplane. FIG. 1 shows a rollaway luggage case 1 which comprises generally a pulling handle 2, a grip 3 and a pair of casters 4 on the back of the case 1. When the user grasps the grip 3 of the pulling handle 2, the rollaway luggage case 1 is to slant an angle to roll with the steps of the user. Because people have different height, this type of rollaway luggage case 1 could not adjust the angle of its pulling handle 2 so that the user is forced to adopt an unnatural posture or stance to pull it, therefore causing uncomfortable.

SUMMARY OF THE PRESENT INVENTION

The present invention has a main object to provide an adjustable pulling handle for rollaway luggage in which the pulling handle can be adjusted to different angle to suit to the height of the user and to keep the rollaway luggage in suitable slant angle so that the user will feel comfortable and save energy to pull it in a natural posture.

Another object of the present invention is to provide an adjustable pulling handle for rollaway luggage in which the adjustment of the pulling handle is easy to operate.

Accordingly, the adjustable pulling handle for rollaway luggage comprises generally a pulling handle telescoped into a pair of elongate sheaths which are spacedly secured to the back of the luggage case, a pair of rotors rotatably secured to a pair of receiving spaces in a top plate to control the pulling handle to rotate into different angles, a downward moving plate and a pair of laterally moving plates cooperated to control the movement of the rotors. When press the downward moving plate to move downward, the rotors are set free to rotate to facilitate the user turning the pulling handle for a suitable slant angle. Then release the downward moving plate to lock the rotors from rotation. The user can comfortably pull the luggage with him and save energy.

The present invention will become more fully understood by reference to the following detailed description thereof when read in conjunction with the attached drawings.

DETAILED DESCRIPTION OF THE PREFERRED EMBODIMENT

Figure 1:
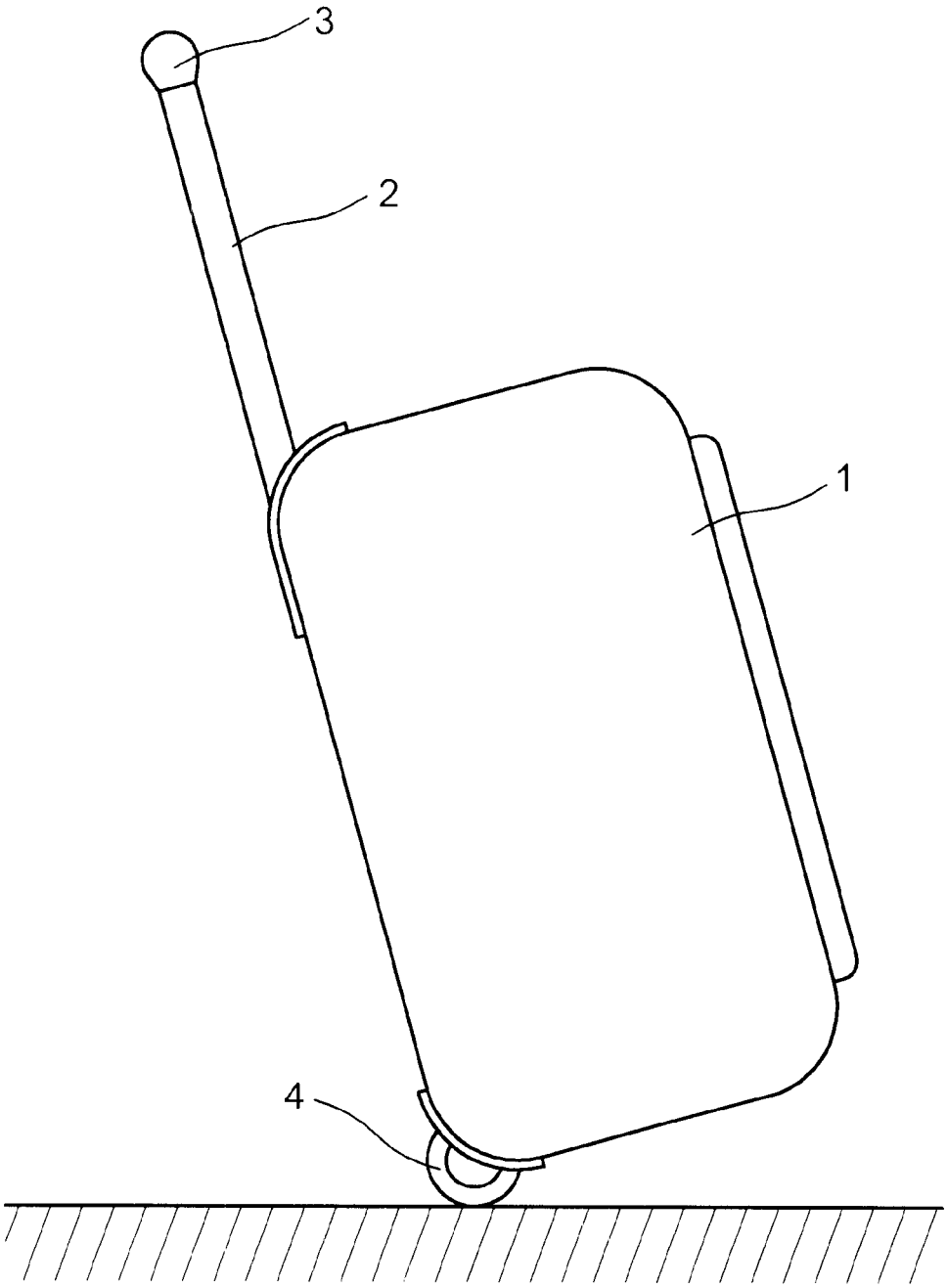
FIG. 1 Prior Art
FIG. 1 is a plane view to show a rollaway luggage according a prior art in which the pulling handle is not adjustable.
Figure 2:
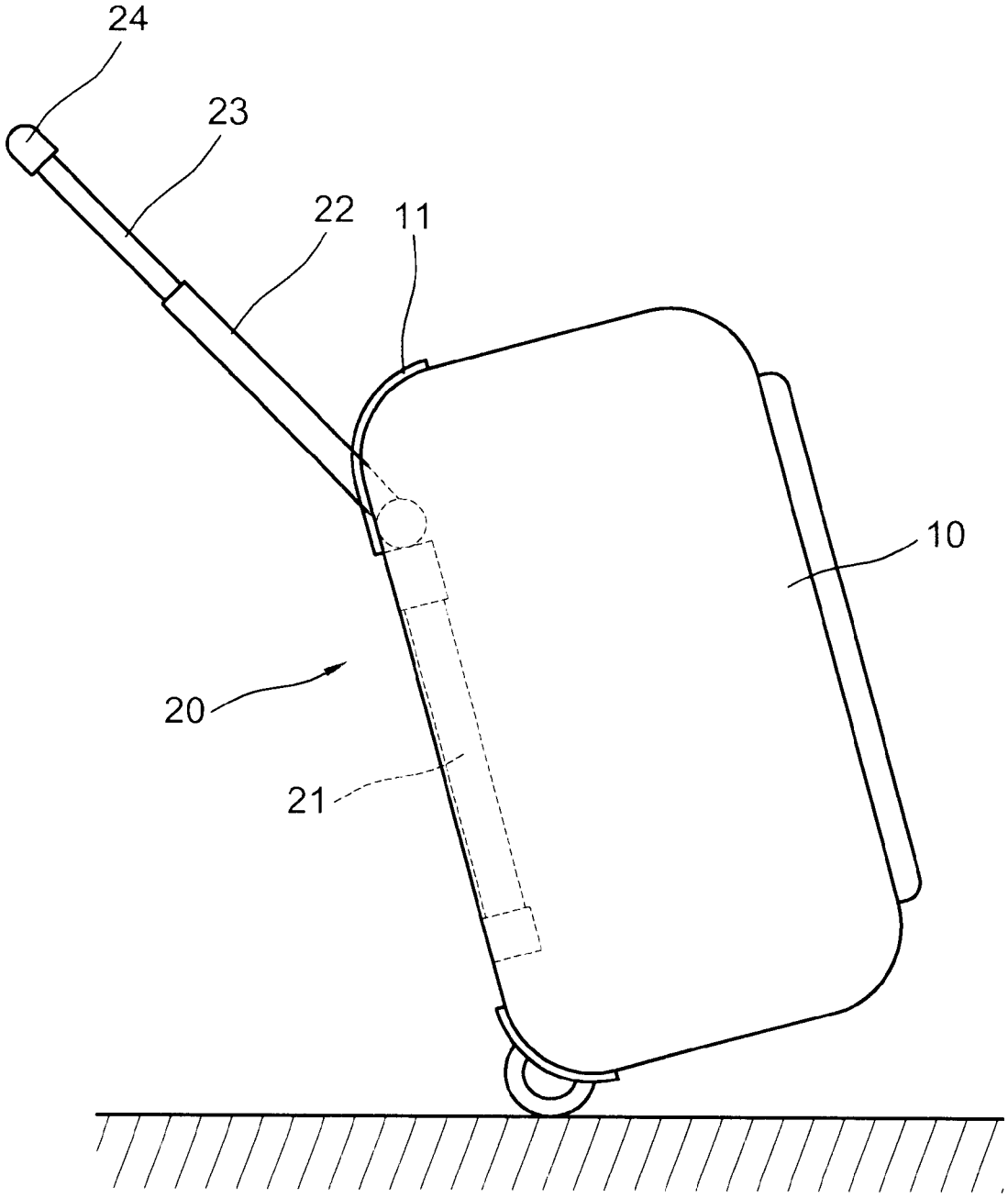
FIG. 2 is a plane view to show a rollaway luggage of the present invention in which the pulling handle is adjustable.
Figure 3:
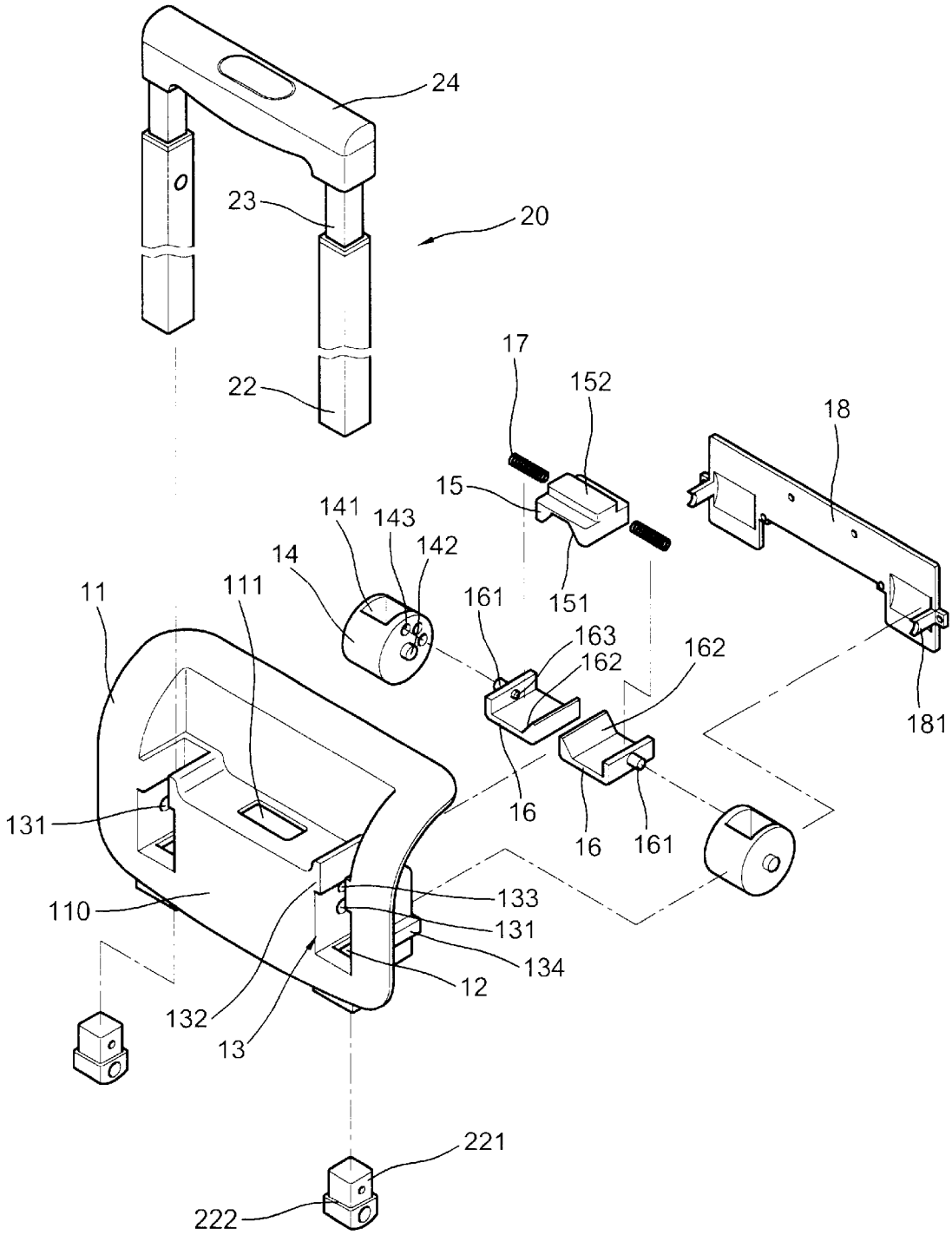
FIG. 3 is an exploded perspective view to show a preferred embodiment of the present invention.
Figure 4:
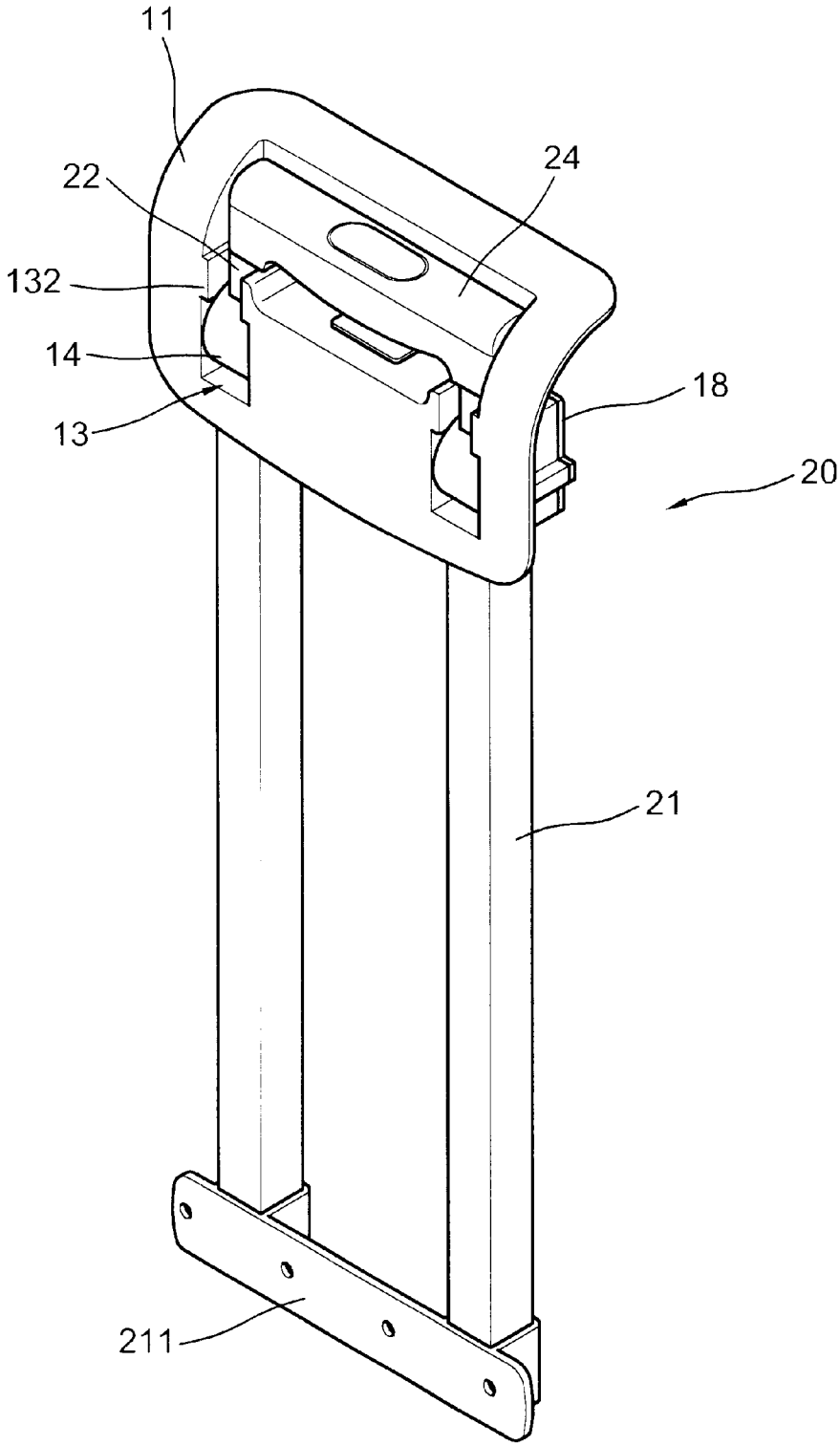
FIG. 4 is a perspective view to show the assembly of FIG. 3.

With reference to FIGS. 2 to 5 of the drawings, the adjustable pulling handle for rollaway luggage of the present invention comprises a pair of casters 101 rotatably and spacedly secured a lower intersection of the back surface and the bottom surface of the luggage case 10, an arcuate top plate 11 secured to an upper intersection of the back surface and the top surface of the luggage case 10 and a pair of handle sheaths 21 for receiving an inverse U-shaped pulling handle 20 spacedly secured to the back surface of the luggage case 10 by a lower plate 211 (as shown in FIG. 4) and each having a rectangular opening in the top.

Figure 5:
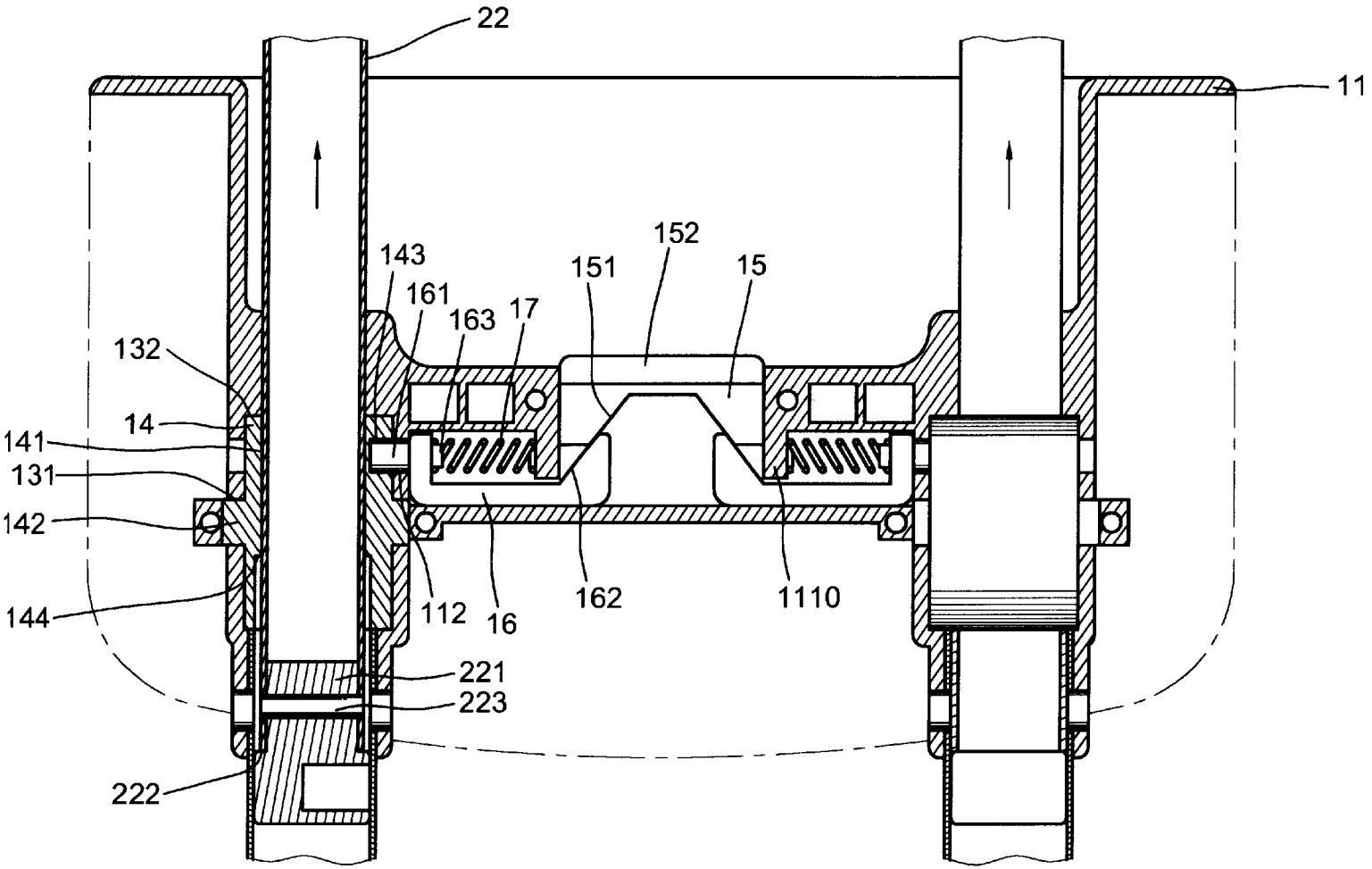
FIG. 5 is a vertical sectional view to show the positions of the components in the top plate.

The top plate 11 has an outer frame, a hollow interior rectangular box 110 on a lower center of the outer frame having an opening in the inner side facing the back surface of the luggage case (not shown), a rectangular thru hole 111 centrally formed in the top including a pair of upright walls 1110 respectively extending downward from two ends thereof inside the box 110 (as shown in FIG. 5), a pair of receiving spaces 13 spacedly formed in two lateral sides of the top plate 11 abutting two ends of the box 110 respectively, each of which is surrounded by a U-shaped side wall 132 and has a rectangular thru hole 12 in the bottom engaged with the opening in the top of the handle sheaths 21 (as shown in FIG. 4), a pair of aligned axial hole 131 in opposing walls, a thru hole 133 in the inner wall above the axial hole 131 and communicating to inside of the box 110 and a transverse retaining cavity 134 projected outward from an outer surface of the U-shaped side wall 132.

A pair of rotors 14 rotatably disposed into the receiving spaces 13 of the top plate 11 respectively each having a rectangular radial hole 141 engageable with the rectangular thru hole 12, a pair of axial rods 142 centrally projected outward from two ends and engaged into the aligned axial holes 131, a plurality of positioning recesses 143 spacedly formed in an inner end around the axial rod 142 and a shoulder 144 formed inside the rectangular radial hole 141 (as shown in FIG. 5).

A downward moving plate 15 disposes into the rectangular box 110 and has a roughly inverse U-shaped body, a pair of bevel lateral walls 151 and a push button 152 on the top protruded out of the rectangular thru hole 111 of the box 110.

A pair of roughly U-shaped laterally moving plates 16 symmetrically dispose into the box 110 under the downward moving plate 15 and each has a bevel lateral wall 162 on inner side engaged with the bevel lateral walls 151 of the downward moving plate 15, a positioning rod 161 on an outer surface of a flat lateral wall passing through the thru holes 133 of the box 110 and selectively engaged into one of the retaining recesses 143 of the rotors 14 and a small projection 163 on the inner side of the flat lateral wall opposite to the positioning rod 161 for engaging with one end of a pair of springs 17 which have their other ends stopped against one side of the upright walls 1110 (as shown in FIG. 5).

Figure 6:
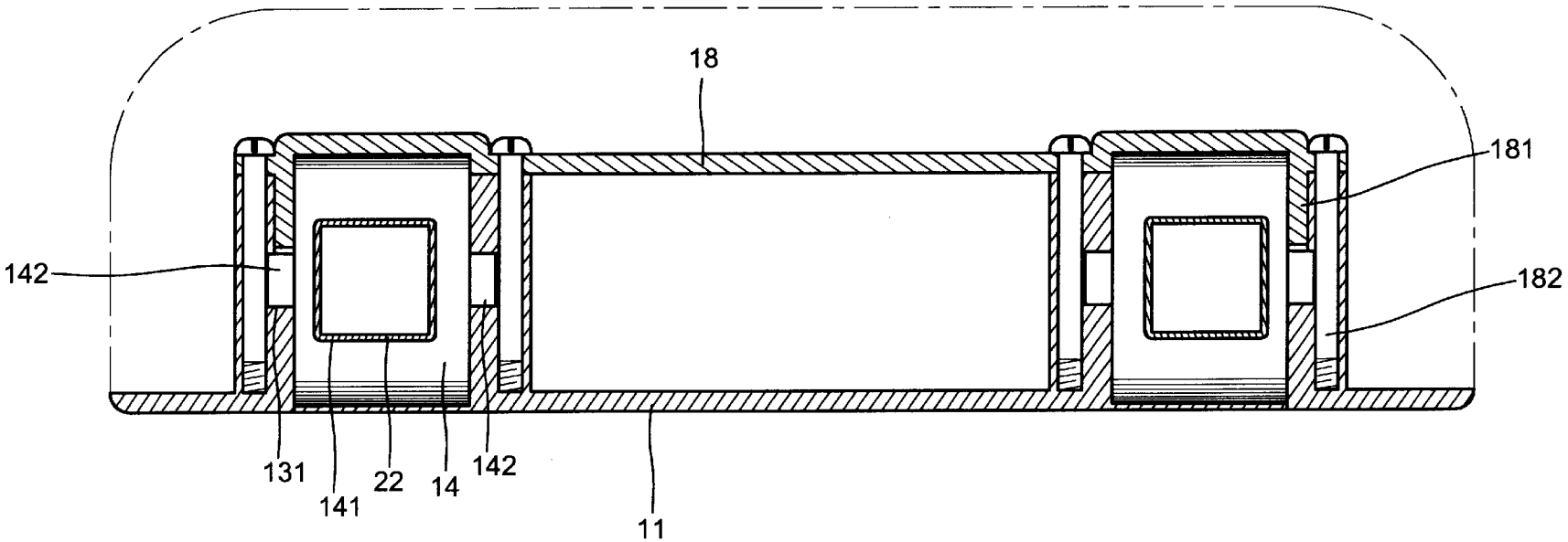
FIG. 6 is a horizontal sectional view to show the cover secured to the top plate.

A cover 18 closes the opening of the rectangular box 110 and has a pair of insertion rods 181 inserted into the retaining cavities 134 on the side walls of the receiving spaces 13 and is secured to the top of the opening by screws (as shown in FIG. 6).

Figure 7:
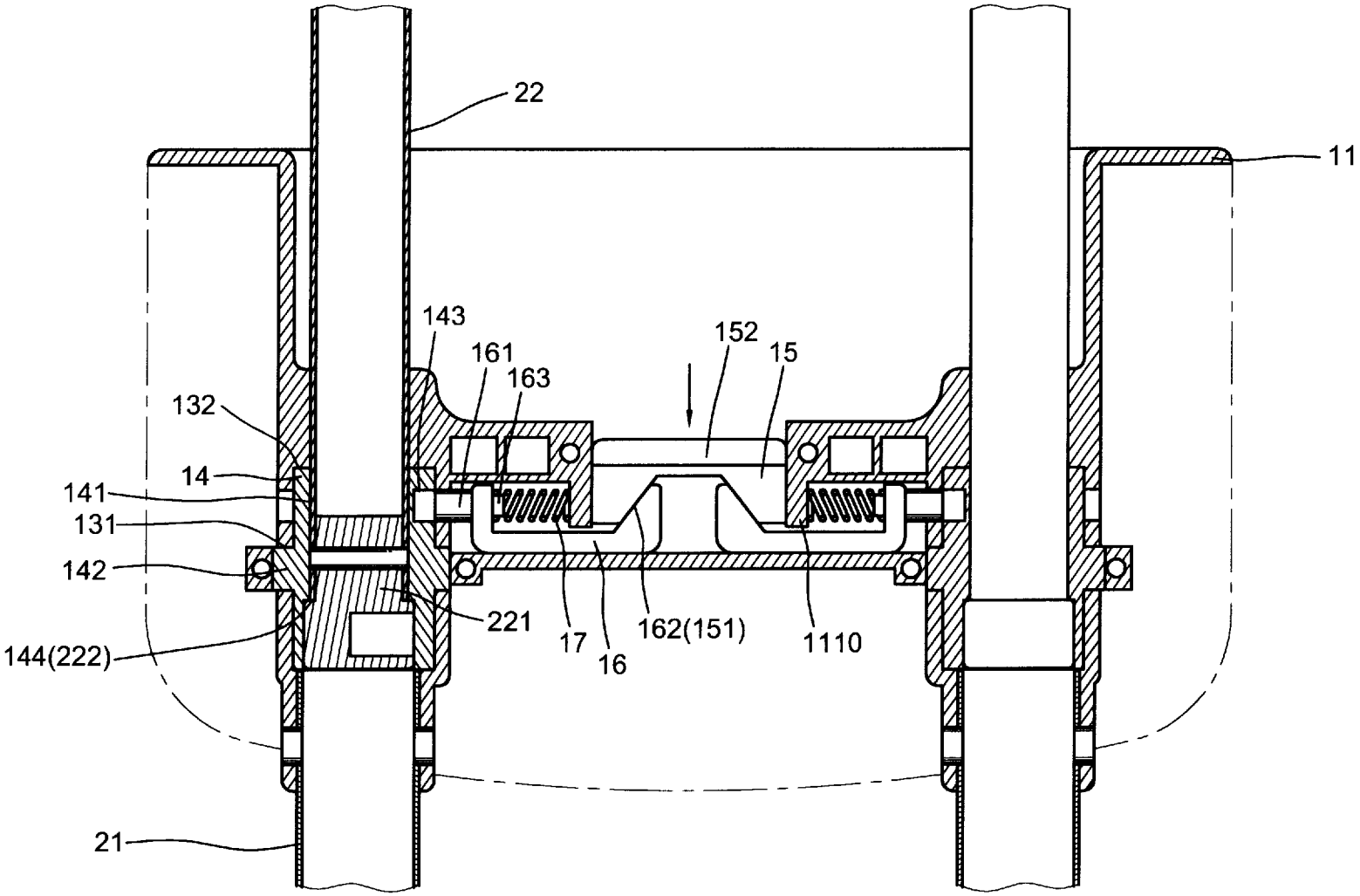
FIG. 7 is a vertical sectional view to show that the downward moving plate is pressed down to force the positioning rod disengaged with the positioning hole of the rotors.
Figure 8:
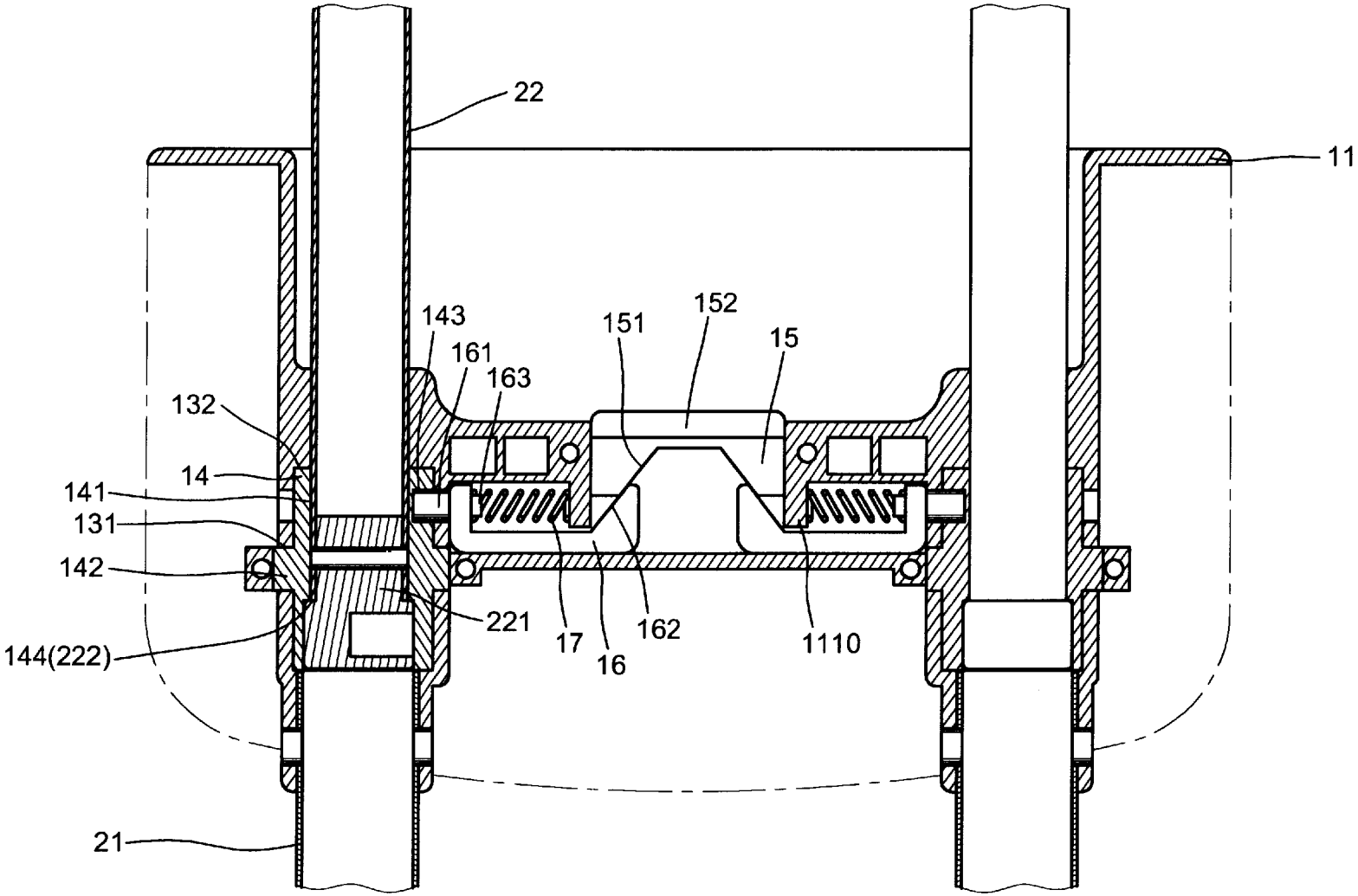
FIG. 8 is a vertical sectional view to show that the downward moving plate is jumped up and the positioning rod is engaged within the positioning hole of the rotor again.

An inverse U-shaped telescopic pulling handle 20 has a pair of telescopic lateral bars of rectangular shaped inserted into the rectangular radial hole 141 of the rotors 14 and the rectangular thru holes 12 of the top plate 11 and then received into the handle sheaths 21 (as shown in FIGS. 5, 7 and 8). The telescopic lateral bars each includes a first tube 22 and a second tube 23 telescoped into the first tube 22. A transverse grip 24 perpendicularly connects to the tops of the second tubes 23 respectively and a pair of corks 221 secure to the lower end of the first tubes 22 respectively. The corks 221 each has an enlarged lower end 222 engageable with and retainable by the shoulders 144 of the rotors 14. The telescopic structure of the first and second tubes 22 and 23 is of conventional that needs no further descriptions.

Figure 10:
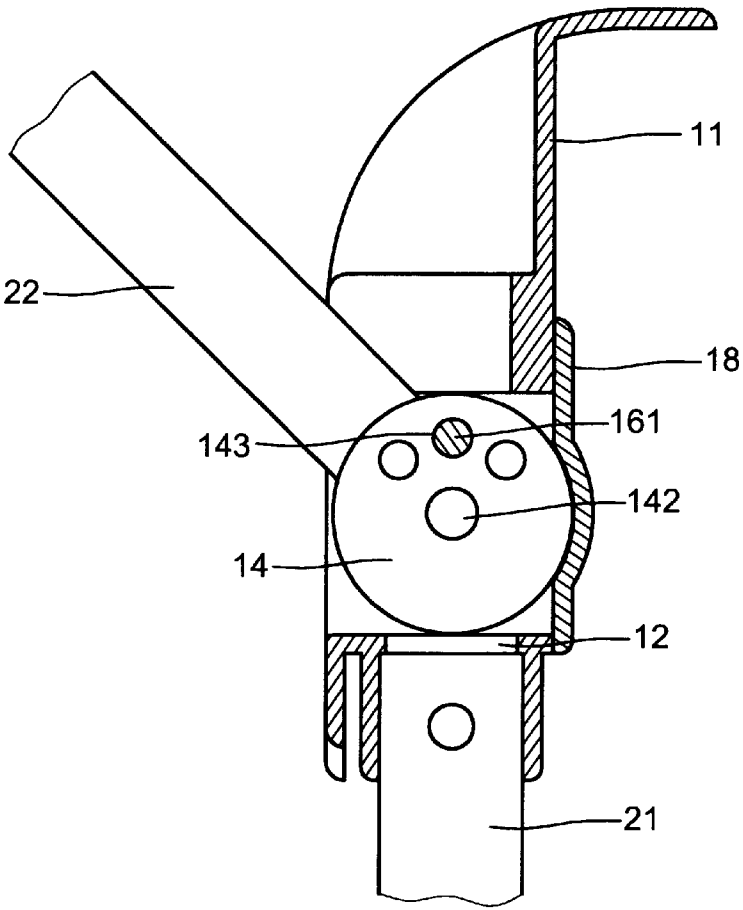
FIG. 10 is a sectional view to illustrate that the pulling handle is turned a certain angle relative to the back of the rollaway luggage.
Figure 9:
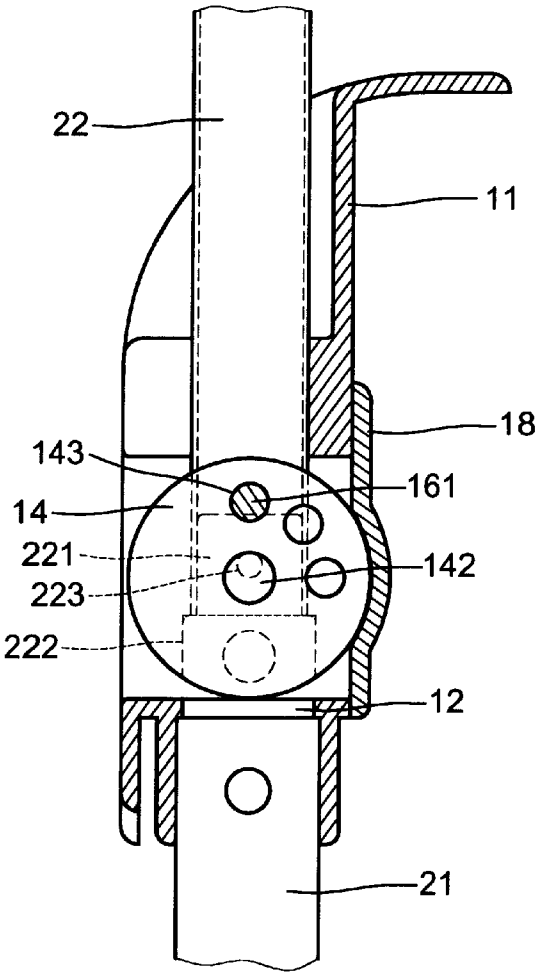
FIG. 9 is a sectional view to illustrate that the pulling handle is parallel to the back of the rollaway luggage.
Figure 11:
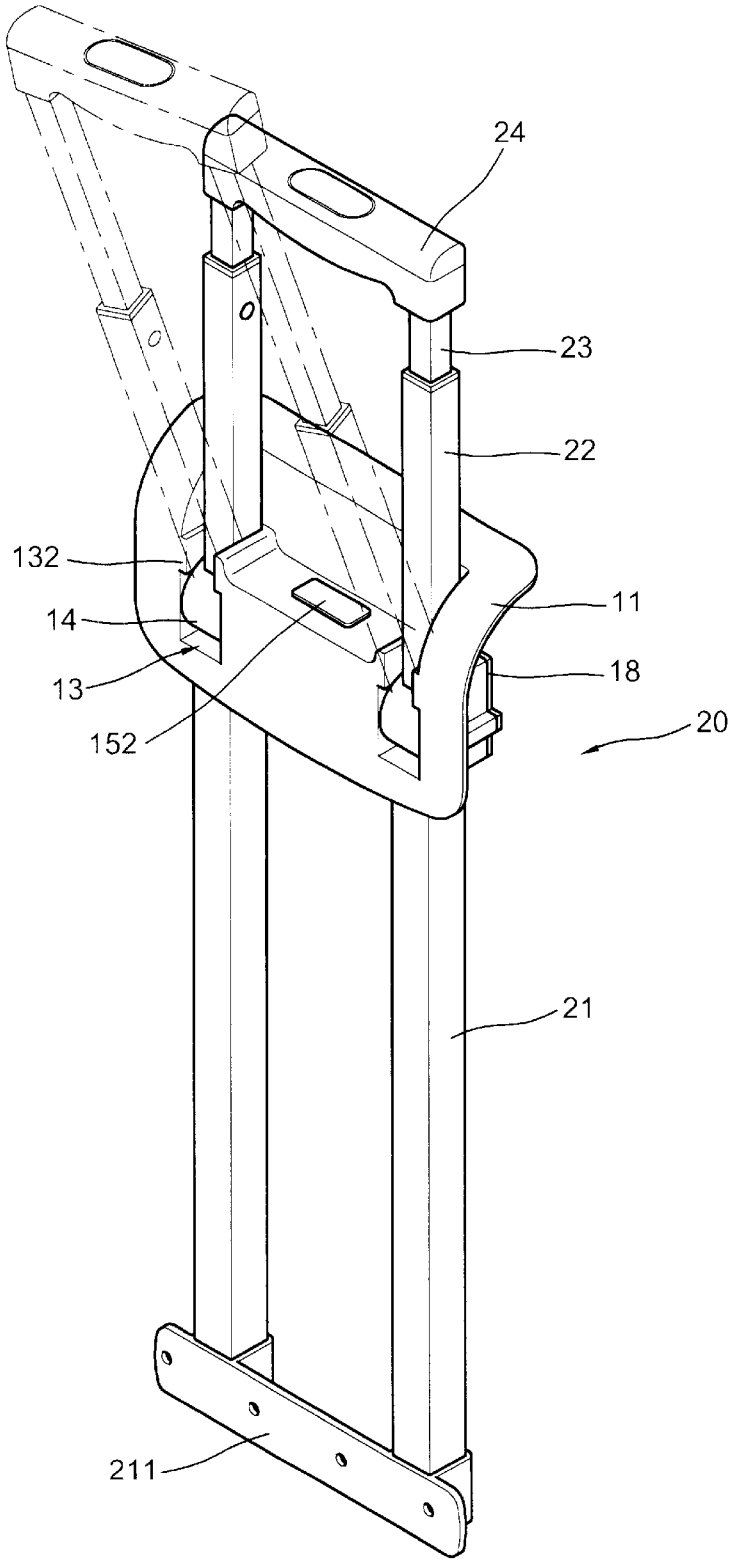
FIG. 11 is a perspective view to show that the pulling handle is rotatable.

Referring to FIG. 9 and FIGS. 5 and 7 again, when grasps the grip 24 and pulls the telescopic bars upward the enlarged lower end 222 of the corks 221 will be retained by the shoulders 144 of the rotors 14 in order to stop the telescopic bars from moving further upward, and the positioning rods 161 of the laterally moving plates 16 are still engaged within an original positioning recesses 143 of the rotors 14 so that the rotors is not rotatable, otherwise, the pulling handle 20 remains parallel to the back surface of the rollaway luggage 10. When pushs the button 152 of the downward moving plate 15 downward, its bevel walls 151 further engage with the bevel wall 162 of the lateral moving plates 16 and forces the lateral moving plates simultaneously moving inward such that their positioning rods 161 simultaneously disengaged with the original positioning recesses 143 therefore to set the rotors 14 free to rotate. Then the user can rotate the pulling handle 20 to seek a suitable slant angle relative to the back surface of the rollaway luggage 10 and then releases the button 152 so that the downward moving plate 15 is jumped up due to the resilience of the springs 17 and the pair of the laterally moving plates 16 that move outward again and its positioning rods 161 engage with other positioning recesses 143 of the rotors 14 which are becoming unmovable again so as the slant pulling handle 20 is stable (as shown in FIG. 10 and 11) and partially shares the slant span. Since the rollaway luggage 10 is in an optimal inclination relative to the ground. By the way, the user can pull or push the rollaway luggage to adopt a natural posture and feels comfortable.

Due to the plurality of the positioning recesses 143 in the rotors 14, the pulling handle 20 can be adjust a plenty of slant angles relative to the back surface of the rollaway luggage in order to fit different heights of the users.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. An adjustable pulling handle for rollaway luggage comprising:

an adjustable pulling handle secured to a back surface of the rollaway luggage which further includes a front surface, a top surface, a bottom surface, a pair of lateral surfaces and a pair of casters rotatably secured spaced apart to a pair of intersections between the back surface and the bottom surface of the luggage;

said adjustable pulling handle comprising an arcuate to plate having an outer frame secured to an intersection between the back surface and the top surface of the luggage, a hollow interior rectangular box on a lower center of the outer frame, a first rectangular through hole centrally formed in a top of the box including a pair of upright walls respectively extending downward from the two ends thereof inside the box, a pair of receiving spaces defined between two lateral ends of the box and the outer frame respectively surrounded by a pair of U-shaped side walls and each of said receiving spaces having a second rectangular through hole in bottom, a pair of aligned axial holes in an lateral wall of the box and the U-shaped side wall, a through hole in the lateral wall of the box above each of the aligned axial holes communicating to inside of the box and a transverse cavity projected outward from an outer surface of the U-shaped side wall;

a pair of handle sheaths parallel disposed spaced apart on the back surface of the luggage, each of the sheaths having a lower end secured to a lower plate and an upper end connected to the second rectangular through holes of the receiving spaces of the arcuate top plate;

a pair of rotors rotatably disposed into the receiving spaces of the arcuate plate respectively and each having a rectangular radial hole engageable with the second rectangular through holes of the receiving spaces including a shoulder formed on inner walls thereof, a pair of axial rods centrally projected outward from two ends respectively engaged into the aligned axial holes of the receiving spaces and a plurality of positioning recesses spacedly formed in an inner end around an axial rod;

an inverse U-shaped downward moving plate disposed into the rectangular box and having a pair of bevel lateral walls projected downward from two ends thereof and a push button projected upward from a top thereof protruded out of the first rectangular through hole of the rectangular box;

a pair of U-shaped laterally moving plates symmetrically disposed into the rectangular box under the downward moving plate and each having a bevel lateral wall on an inner side engaged with one the bevel lateral walls of the downward moving plate respectively, a positioning rod projected outward from an outer surface of a flat lateral wall which positions opposite to the bevel lateral wall and passing through the through hole of the rectangular box and selectively engageable into one of the positioning recesses of the rotors and a small projection projected inward from an inner side of the flat lateral wall being opposite to the positioning rod;

a pair of spring means having one end secured to the small projections of the lateral moving plate and the other end stopped against one side of the upright walls of the rectangular box respectively;

a cover closed an opening in inner side of the rectangular box and having a pair of insertion rods on two ends thereof inserted into the transverse retaining cavities on the side walls of the receiving spaces and secured to a top of the opening by screws;

an inverse U-shaped telescopic pulling handle having a pair of rectangular telescopic lateral bars inserted into the pair of the handle sheath respectively through the rectangular radial holes of the rotors and the second rectangular through holes of the receiving spaces, said telescopic lateral bars each having a first tube sealed in lower end by a pair of corks each of which has an enlarged lower end engageable and retainable by the shoulders of the rotors and a second tube telescoped into top of the first tube and a transverse grip having two ends connected to top of the second tube respectively;

whereby pull the pulling handle upward and press the button of the downward moving plate, the pulling handle can be rotated to select an optimal angle relative to the back surface of the luggage.

* * * * *